United States Patent [19]

Jentoft

[11] Patent Number: 4,527,368

[45] Date of Patent: Jul. 9, 1985

[54] SKYLIGHT SEALING

[75] Inventor: Arthur P. Jentoft, Kennebunkport, Me.

[73] Assignee: Wasco Products, Inc., Sanford, Me.

[21] Appl. No.: 453,339

[22] Filed: Dec. 27, 1982

[51] Int. Cl.[3] ..... E04B 7/18

[52] U.S. Cl. ..... 52/200; 52/58; 52/213; 49/484

[58] Field of Search ..... 52/200, 58, 208, 213; 49/484, 495

[56] References Cited

U.S. PATENT DOCUMENTS

| | | | |
|---|---|---|---|
| 2,703,060 | 3/1955 | Kiefer | 52/200 X |
| 3,404,495 | 10/1968 | Simpson | 52/58 |
| 3,761,347 | 9/1973 | Yackiw | 49/484 X |
| 3,921,352 | 11/1975 | Koopman et al. | 52/200 |
| 3,974,606 | 8/1976 | LaBorde | 52/213 X |

FOREIGN PATENT DOCUMENTS

| | | | |
|---|---|---|---|
| 2906453 | 8/1980 | Fed. Rep. of Germany | 52/58 |
| 1507998 | 12/1967 | France | 52/200 |

*Primary Examiner*—Donald G. Kelly
*Assistant Examiner*—Naoko N. Slack
*Attorney, Agent, or Firm*—Wolf, Greenfield & Sacks

[57] ABSTRACT

A technique for sealing a skylight at its curb frame flange about an opening in a building and in which the sealing technique is a dry sealing technique. The improvement comprises dry seal element means extending integrally from the underside surface of the flange and being flexible and adapted to bend and compress to a position substantially parallel to the flange upon securing of the curb frame flange to the building.

14 Claims, 5 Drawing Figures

SKYLIGHT SEALING

BACKGROUND OF THE INVENTION

The present invention relates in general to skylights and the like, and is concerned, more particularly, with an approved technique for sealing the skylight about a roof or other building opening.

At the present time, a skylight is conventionally secured to a roof or other appropriate part of the building with the use of a roofing mastic. In an existing building, after the roof opening has been made, the roofing mastic is applied on the deck around the opening to provide a seal between the deck and the flange of the skylight. Once the roofing mastic is applied, then the skylight is positioned over the opening and the flange is then pressed firmly into the mastic to provide a water tight seal. The skylight flange is then nailed to the roof and additional mastic applied. Shingling is then completed about the entire skylight.

Now, there are a number of disadvantages associated with this conventional well-known procedure for sealing a skylight. There is extra expense associated in purchasing the roofing mastic and there is associated expense of the labor involved in applying the mastic. The application of a roofing cement also adds to the installation time of the skylight unit. The roofing mastic product is extremely messy, particularly for an inexperienced remodeler or one involved in a do-it-yourself project. Furthermore, the success of the installation, particularly as it relates to resisting water leakage is a function of steps that are taken that take place in the field and have nothing to do with the manufacturing of the unit. Because of this , there are many uncertainties that are involved. Also, the resistance of the unit to leakage involves the proper performance of the mastic. Because there are a large number of different mastics that are available, this introduces great variables into the desired performance.

Accordingly, it is an object of the present invention to provide an improved technique for the sealing of the skylight about the skylight opening.

Another object of the present invention is to provide a sealing technique as in accordance with the previous object, particularly adapted for sealing skylights and which is a dry seal technique.

A further object of the present invention is to provide an improved sealing technique as set forth hereinbefore and in which the sealing is provided by dry seal, co-extruded elements associated with the skylight flange.

Still another object of the present invention is to provide a technique for sealing a skylight to a building about an opening in the building and without requiring the use of messy, expensive and time consuming roofing cements or mastics.

Still a further object of the present invention is to provide an improved skylight sealing technique that eliminates uncertainties when the unit is intalled in the field due to inherent invariables associated with field installation.

Still another object of the present invention is to provide an improved skylight sealing technique that is particularly useful in skylight installations wherein skylights are butted closely together. Adjacent skylight flanges are adapted to overlap without the required use of caulking or mastic therebetween.

SUMMARY OF THE INVENTION

To accomplish the foregoing and other objects of this invention, there is provided a skylight for covering an opening in a building having a curb frame with a peripheral support flange extending thereabout for support of the curb frame about the opening in the building. The improvement in accordance with the invention comprises dry seal element means extending integrally from and angularly to the underside surface of the flange. These dry seal element means are flexible and adapted to bend and press to a position substantially parallel to the flange upon securing of the curb frame flange to the building about the opening. The flange is typically secured by means of a series of roofing nails. In accordance with the present invention, the dry seal element means may comprise a series of elements with at least one of these elements being pierced by a roofing nail so as to enhance the sealing characteristics and also seal against leakage around the nail itself. Moreover, in accordance with the invention, there is preferably provided a further flexible element on the upper outside tip of the rigid flange of the skylight. This stops the lateral movement of rainwater along the sloping sides of the skylight and prevents leakage under the shingles that are placed over the flanges during installation. In a preferred embodiment the pierced dry seal element preferably has a pair of additional ears or projections so as to assure proper upward pressure around the roofing nail for sealing when the roofing nail is installed. Also, in accordance with the invention, the peripheral support flange with its dry seal elements is constructed so as to enable ready overlap of adjacent flanges in order to allow the skylight units to be butted closely together.

BRIEF DESCRIPTION OF THE DRAWINGS

Numerous other objects, features and advantages of the invention should now become apparent upon a reading of the following detailed description taken in conjunction with the accompanying drawing, in which.

DETAILED DESCRIPTION

Figure 1:
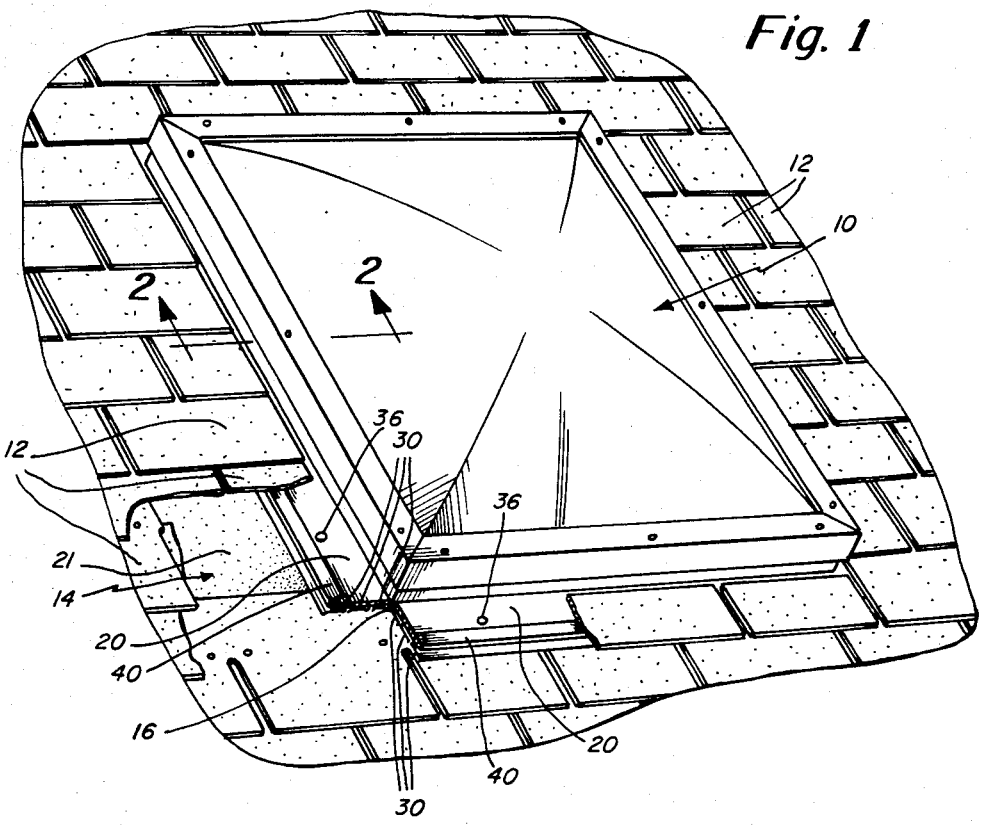
FIG. 1 is a perspective view showing the skylight secured to the roof of a building and partially cut away to expose characteristics of the sealing technique of the invention.
Figure 2:
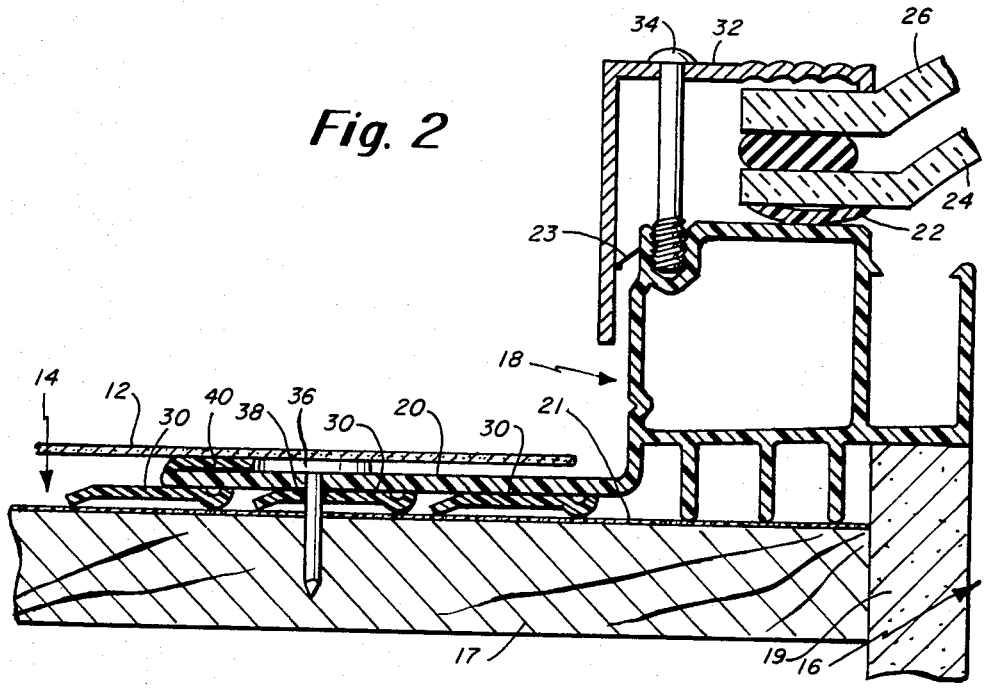
FIG. 2 is a cross-sectional view taken along line 2—2 of FIG. 1 showing the flange of the skylight in its secured down position.
Figure 3:
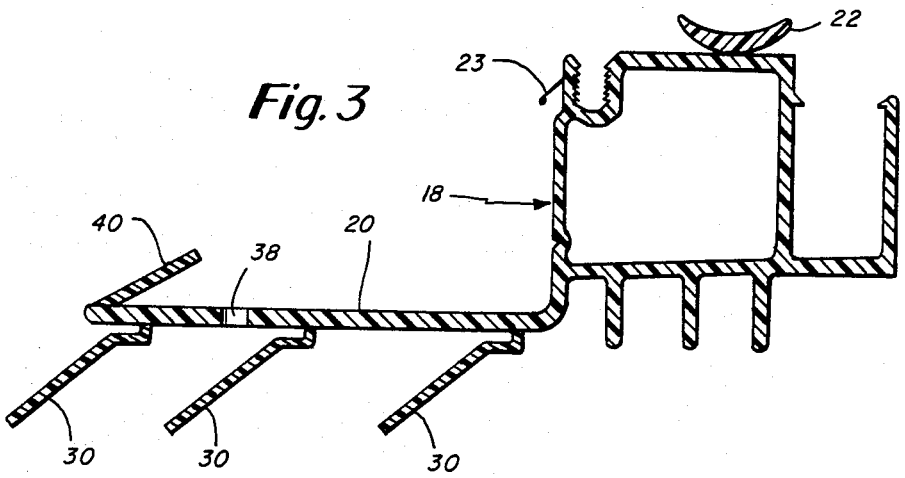
FIG. 3 is a cross-sectional view of the curb frame extrusion.

FIG. 1 illustrates in a perspective view the skylight 10 indicating some of the shingles 12 being removed so as to permit installation of the skylight in connection with an installation application in which the building has a pre-existing roof already shingled. Further detail of the skylight and the sealing techniques of this invention is illustrated in FIG. 2. FIG. 3 shows the curb frame extrusion alone.

In making the installation in the roof 14, the proper size opening 16 is cut to accommodate the skylight. As indicated hereinbefore previously, a mastic was applied about the opening to provide a sealing about the skylight flange and the roof decking. However, in accordance with the present invention, this is no longer necessary, the skylight simply being positioned properly in the opening with the dry seal elements of the skylight integrally formed therewith providing the water tight sealing that is necessary.

FIG. 2 shows the details of the curb frame 18 which includes the securing flange 20. The curb frame 18 includes a gasket 22 for support of the skylight domes 24 and 26. The entire details of the curb frame are not described herein in that most of the curb frame construction is known. However, the flange 20 and associated dry seal elements 30 are formed in accordance with the present invention. For further discussion of the other details of the curb frame 18, reference may be made to copending application Ser. No. 175,306 filed Aug. 4, 1980 or copending application Ser. No. 148,974 filed May 12, 1980.

In addition to the curb frame 18 and the domes 24 and 26, there is also shown in FIG. 2 the L-shaped retainer 32 and associated bolt 34. The retainer 32 maintains the pair of domes in proper contact with the curb frame and in particular with the co-extruded integral gasket 22 associated with the curb frame 18. Also indicated in FIG. 2 is the roof decking 17 and an associated finish piece 19 which forms part of the roof opening 16. The decking 17 has the flange 20 secured directly thereto.

FIG. 2 also clearly indicates the use of a roofing nail 36 that extends through a preferably pre-drilled hole 38 in the flange 20. The holes 38 are disposed along the periphery of the flange at predetermined intervals as also illustrated in FIG. 1.

In the embodiment illustrated in FIGS. 1–3, there are provided three such dry seal flexible elements 30. These are co-extruded with the flange 20. The flange 20 is constructed of a relatively rigid PVC plastic while the elements 30 are constructed of a softer flexible plastic which is also PVC. This provides a series of flexible elements below the flange to provide the proper seal. In an alternate embodiment, a single element could be provided. In either case, there is provided a fool-proof, simple, inexpensive and labor-free dry seal which will always function the same in the field. This has the effect of eliminating all field application uncertainties and difficulty on the part of particularly, an inexperienced homeowner in installing the skylight.

It is also noted in FIG. 2 that the roofing nail 36 used in installation of the skylight is caused to pass through one of the flexible elements 30 that are disposed below the flange. In the illustration of FIG. 2, this passes through the middle one of the elements 30.

It is also preferred to have a pre-punched hole 38 in that the flange itself is too heavy to allow a nail to pass through easily. Thus, the hole 38 is either punched or drilled in the flange to accommodate the nail. By causing the nail to pass through the unpunched flexible element 30, a seal against leakage is provided around the nail. Also, the flange hole 38 is preferably punched because most plastics are notch sensitive and hence any unpunched nail hole could cause progressive crack propagation.

In addition to the sealing provided by the element 30 it should also be noted that shingles are placed over the flange particularly on the top and sides of the sloped roof. Thus, the shingles first direct most rain water away from the flange. In this connection, the shingles are also preferably maintained under the flange at the bottom of the skylight on a sloped roof.

FIG. 2 also illustrates the preferred use of a layer of roofing felt 21 which is disposed over the deck 17. When the roof opening is first opened, normally the felt is maintained about the roof opening or if new felt is required, this is applied prior to installation of the skylight.

In accordance with the present invention it is also desired to provide one additional flexible element 40 which is arranged at the very outside tip on the upper surface of the rigid flange 18. In FIG. 2 one of the shingles 12 is shown over and compressing this element 40. In FIG. 3 the element 40 is shown in its normal extended position with their being an angle on the order of about 30° between the element 40 and the planar surface of the flange 20. Also, in FIG. 3 the elements 30 are shown in their uncompressed position forming an angle of about 45° with the planar surface of the flange 20.

The upper element 40 extends about the periphery of the flange as do the elements 30. The element 40 stops the lateral movement of rain water, along the sloping sides of the skylight, under the shingles that are placed over the flanges during installation. As indicated previously, FIG. 2 shows this element depressed by the shingles 12 placed over the flange during installation. The element is compressed by the shingles along the upper side of the skylight and along the sloping sides. At the lower side of the skylight the rigid flange is placed over the shingles, and thus the element would be exposed along this side. However, it is preferred to provide a second layer of shingles at the bottom of the skylight over the lower flange to conceal the flange for aesthetic purposes.

FIG. 2 shows the skylight curb frame installed with the nail 36 having been hammered through the pre-punched hole 38 to pierce one of the elements 30 and at the same time secure the flange to the roof decking 17. FIG. 3 shows the position of the different elements 30 and 40 in the curb frame extrusion. All of these elements are co-extruded and are of a flexible material to provide flexible sealing elements. FIG. 3 also shows the co-extruded flexible gasket 22 and an additional flexible gasket 23. Other characteristics including the details as to the hardness of the different parts of the curb frame are described in the aforementioned copending applications.

Figure 4:
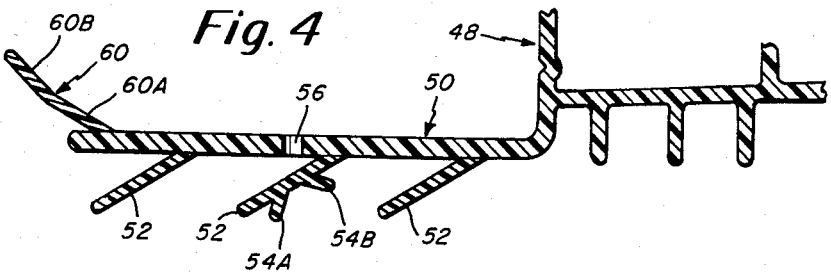
FIG. 4 is a cross-sectional view of a preferred embodiment of the curb frame extrusion.

FIG. 4 is a cross-sectional view of a preferred embodiment of the curb frame extrusion. It is noted in FIG. 4 that the construction is quite similar to the construction shown in the cross-sectional view of FIG. 3. FIG. 4 illustrates the curb frame 48 which includes the securing flange 50. As with the embodiment of FIG. 3, the embodiment of FIG. 4 has three dry-seal flexible elements 52. Each of these elements are co-extruded with the flange 50. The flange 50 is preferably constructed of a relatively rigid PVC plastic while the elements 52 are constructed of a softer flexible plastic which is also preferably PVC. This provides a series of flexible elements below the flange to provide the proper seal. However, it is noted in FIG. 4 that the middle flexible element 52 has a pair of ears or projections 54A and 54B which respectively extend at an angle of about 45° from the general plane of the middle element 52. The ears 54A and 54B thus form an angle therebetween of approximately 90°. It is noted in FIG. 4 that just above this middle element 52 there is provided a hole 56 which is preferably pre-punched in the flange to allow a nail to pass through it easily. This hole may either be punched or drilled in the flange to accommodate the nail. The nail is caused to pass through the hole 56 and through the unpunched flexible element 52 with the nail passing between the ears 54A and 54B. This provides a seal against leakage by sealing around the nail. The ears on the gasket extending under the main sealing element 52 assure that upward pressure occurs around the roofing nail for providing proper sealing when the roofing nail is installed. Reference is made hereinafter to the view of FIG. 5 which shows the sealing elements in their finally installed sealed position with the nail installed.

FIG. 4 also shows, associated with the flange 50, an upper element 60 essentially analogous to the element 40 illustrated in FIGS. 2 and 3. However, the upper element 60 illustrated in FIG. 4 is directed outwardly instead of the inwardly directed element 40 in FIG. 3. Also, the element 60 is essentially provided in two sections 60A and an outer section 60B. The section 60A forms an angle of approximately 30° with the plane of the flange 50 while the section 60B forms an angle of approximately 45° with the plane of the flange 50 as clearly illustrated in FIG. 4.

Figure 5:
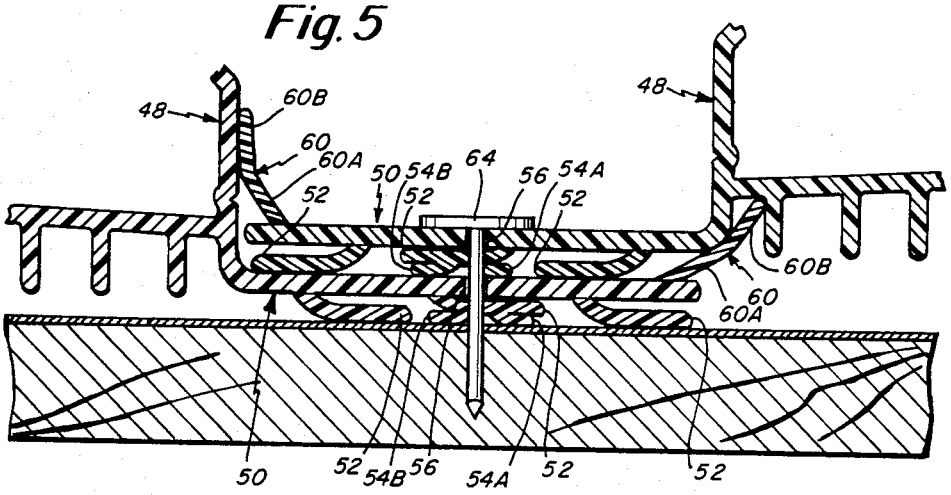
FIG. 5 is a cross-sectional fragmentary view showing two adjacent curb frame flanges of the type illustrated in FIG. 4 and overlapped to allow skylight units to be butted closely together.

Reference is now made to the fragmentary view of FIG. 5. In FIG. 5 the same reference characters have been used to identify the flanges and the associated flexible sealing elements 52 and 60. The extrusion illustrated in FIG. 5 is substantially identical to the one illustrated in FIG. 4 with the middle sealing element 52 having the aforementioned ears 54A and 54B. FIG. 5 shows the adjacent flanges in their overlapped butted position. It is noted that the upper sealing element 60 associated with the upper flange 50 is adapted to bend and provide a sealed joint between the upper flange 50 and the inner upright wall of the curb frame 48; that is the curb frame 48 illustrated to the left in FIG. 5.

It is also noted in FIG. 5 that the nail 64 is of a length so that it can pass through both of the holes 56 in the respective flanges 50 as well as through the respective middle sealing elements between the ears 54A and 54B. There is thus provided in the arrangement of FIG. 5 an effective technique for permitting two adjacent flanges to be overlapped in order to allow units to be butted closely together. It has also been found that this arrangement allows individual skylights to be stocked in dealerships which can either be used individually or can be closely joined, particularly for use in connection with solar appurtenances in homes and other building constructions. In this connection it is noted that at the current time adjoining units must either be custom fabricated, or they must be heavily caulked in the field at the joint between them. The construction shown in FIG. 5 eliminates any heavy caulking and also eliminates the necessity for custom fabrication.

Having described a limited number of embodiments of the present invention, it should now be apparent to those skilled in the art that numerous other embodiments and modifications thereof are contemplated as falling within the scope of this invention. For example, although in the preferred embodiment the nail is adapted to pass through one of the sealing elements, preferably the middle one, in an alternate embodiment, the nail may penetrate the flange but not the sealing element. In this case the sealing of the nail may be accomplished with the use of a gasket or mastic on the nail.

What is claimed is:

1. In a skylight apparatus for covering an opening in a building having a curb frame with a peripheral support flange extending thereabout for support of the curb frame about said opening, said flange having an underside surface, the improvement comprising; dry seal element means extending integrally from and angularly to the underside surface of said flange, said dry seal element means being flexible and adapted to bend and compress to a position substantially parallel to said flange upon securing of the curb frame flange to the building about said opening, said dry seal element means being co-extruded with said curb frame with said dry seal element means being of a more flexible material to provide liquid tight sealing and with the curb frame flange being of a more rigid material than the dry seal element means, and securing means adapted to extend through at least said curb frame flange for compressing said dry seal element means into sealing contact about said opening.

2. In a skylight apparatus as set forth in claim 1 wherein said securing means penetrates both said curb frame flange and said dry seal element means.

3. In a skylight apparatus as set forth in claim 1 wherein said dry seal element means comprise a plurality of periphally disposed dry seal elements.

4. In a skylight apparatus as set forth in claim 1 wherein said securing means penetrates both said curb frame flange and dry seal element means with only said flange being predrilled or prepunched to receive said securing means whereby the penetration of the dry seal element means causes an impression thereof and sealing with said securing means.

5. In a skylight apparatus as set forth in claim 1 wherein said means for securing includes nail means and wherein said flange is pre-drilled or pre-punched to receive said nail.

6. In a skylight apparatus as set forth in claim 5 including a further flexible element disposed extending from a top side surface of said flange.

7. In a skylight apparatus as set forth in claim 1 including an additional sealing element extending integrally from and angularly to the upper side surface of said flange.

8. In a skylight apparatus as set forth in claim 7 wherein said flexible element extends from a tip of said flange.

9. In a skylight apparatus as set forth in claim 7 wherein said additional sealing element extends angularly outward.

10. In a skylight apparatus as set forth in claim 7 wherein said additional sealing element extends angularly inward.

11. In a skylight apparatus as set forth in claim 1 wherein said dry seal element means comprise at least one peripherally disposed dry seal element having a pair of ears extending downwardly therefrom and positioned on either side of a nail piercing the dry seal element so as to assure a proper seal when the roofing nail is installed.

12. In a skylight apparatus as set forth in claim 1 including a second curb frame also with a peripheral support flange and dry seal element means and associated with another opening, wherein said flanges are positioned in an overlap arrangement in order to allow the skylight apparatus units to be butted closely together.

13. In a skylight apparatus as set forth in claim 12, wherein both said flanges are aligned so that a nail or the like can pierce both flanges compressing said dry seal element means for securing both frames together without the necessity of mastic or the like application.

14. A method of supporting two skylight apparatuses in close butting relationship wherein each skylight covers an opening in a building having a curb frame with a peripheral support flange extending thereabout for support of the curb frame about each respective opening, each curb frame flange having dry seal element means extending integrally from and angularly to the underside surface of said flange, said dry seal element means being flexible and being adapted to bend and compress to a position substantially parallel to said flange upon securing of the curb frame flange to the building about said opening, said method comprising the steps of placing one of said curb frames with its associated flange extending in a first direction, placing the second curb frame with its flange extending in the opposite direction and overlying the flange of the first curb frame fastening both flanges concurrently, and compressing both said curb frame flange and said dry seal element means to provide a tight seal between the curb frame flanges.

* * * * *